US012252981B2

(12) United States Patent
Baghdadi

(10) Patent No.: US 12,252,981 B2
(45) Date of Patent: Mar. 18, 2025

(54) SYSTEMS FOR DEPLOYING DOWNHOLE GAS-LIFT TRACERS

(71) Applicant: SAUDI ARABIAN OIL COMPANY, Dhahran (SA)

(72) Inventor: Faical Baghdadi, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/296,299

(22) Filed: Apr. 5, 2023

(65) Prior Publication Data

US 2024/0337184 A1 Oct. 10, 2024

(51) Int. Cl.
*E21B 43/12* (2006.01)
*E21B 47/11* (2012.01)

(52) U.S. Cl.
CPC ..... *E21B 47/11* (2020.05); *E21B 43/123* (2013.01)

(58) Field of Classification Search
None
See application file for complete search history.

(56) References Cited

U.S. PATENT DOCUMENTS

| | | | | |
|---|---|---|---|---|
| 4,972,704 | A | 11/1990 | Wellington et al. | |
| 5,031,697 | A | 7/1991 | Wellington et al. | |
| 5,246,860 | A * | 9/1993 | Hutchins | G01N 33/241 436/27 |
| 8,150,637 | B2 | 3/2012 | Peacock et al. | |
| 10,253,619 | B2 | 4/2019 | Nyhavn | |
| 2012/0234556 | A1* | 9/2012 | Hallundbæk | E21B 43/123 166/372 |
| 2018/0275114 | A1* | 9/2018 | Kosynkin | G01N 30/7206 |
| 2021/0363864 | A1* | 11/2021 | Johnson | E21B 34/06 |
| 2022/0397031 | A1* | 12/2022 | Gomes | E21B 27/02 |

FOREIGN PATENT DOCUMENTS

| | | | |
|---|---|---|---|
| WO | 2015191026 | A1 | 12/2015 |
| WO | 2017065863 | A1 | 4/2017 |

OTHER PUBLICATIONS

Gomes, Jorge , Narayanan, Ram , Alshmakhy, Ahmed , and Ali Al Rawahi. "Deployment of Water Tracers Using Modified Dummy Gas Lift Valves—An Added Value to Field Operations and Reservoir Management." Paper presented at the Abu Dhabi International Petroleum Exhibition & Conference, Abu Dhabi, UAE, Nov. 2020. doi: https://doi.org/10.2118/202782-MS.

* cited by examiner

*Primary Examiner* — Andrew Sue-Ako
(74) *Attorney, Agent, or Firm* — Vorys, Sater, Seymour and Pease LLP

(57) ABSTRACT

A well system includes a wellbore extending from a surface location, production tubing arranged within the wellbore and thereby defining an annulus between the production tubing and an inner wall of the wellbore, a plurality of gas-lift valves arranged on the production tubing and operable to receive a lift gas from the annulus and discharge the lift gas into an interior of the production tubing, a unique tracer provided at each gas-lift valve and releasable into the interior of the production tubing as the lift gas circulates through a corresponding one of the plurality of gas-lift valves, and a tracer detection system arranged at the surface location and operable to detect the unique tracer comingled with the lift gas and a production fluid circulating within the production tubing.

20 Claims, 7 Drawing Sheets

SYSTEMS FOR DEPLOYING DOWNHOLE GAS-LIFT TRACERS

FIELD OF THE DISCLOSURE

The present disclosure relates generally to hydrocarbon exploration operations in a subterranean well and, more particularly, to downhole gas-lift operations including downhole valve-actuated tracers.

BACKGROUND OF THE DISCLOSURE

Subterranean formation well drilling operations, such as those to recover hydrocarbons, typically involve the circulation of a drilling fluid through an interior length of drill pipe. A drill bit is arranged at the distal end of the drill pipe and a mud pump operates to pump the drilling fluid into the drill pipe where it circulates to the drill bit and is discharged from the drill bit via a plurality of orifices to form a wellbore. After reaching a predetermined wellbore depth, the drill pipe is removed and casing or another type of wellbore liner is placed within the wellbore and typically cemented therein to prevent wellbore collapse. The casing is then perforated at one or more locations or zones to allow reservoir fluids (e.g., hydrocarbons) to flow into the wellbore. A string of production tubing is then extended into the wellbore and one or more wellbore isolation devices or "packers" are set within the annulus defined between the production tubing and the inner wall the casing. The hydrocarbons flowing into the wellbore may be conveyed to a well surface location via of the production tubing.

In some wells, there is insufficient reservoir pressure to overcome the hydrostatic head in the production tubing. In such cases, a gas-lift operation may be undertaken to assist the flow of the reservoir fluid (hydrocarbons) to the surface. Gas-lift lift operations increase well production by injecting a gas stream (e.g., treated produced gas, air, or $N_2$) from the well surface, down the wellbore annulus, and through a plurality of gas-lift valves provided in corresponding gas-lift mandrels located at predetermined locations along the length of the production tubing. This process operates to unload the well and subsequently gas, for gas lift will be injected from an operating valve which is usually an orifice valve. To monitor, survey, troubleshoot, and optimize a gas-lift operation, a tracer material or "tracer" is sometimes injected into the annulus with the lift gas. Timing when the tracer is detected back at the well surface may provide a well operator with an idea as to which gas-lift valves are open or closed, and whether the gas-lift operation is proceeding according to plan.

Traditional gas-lift tracer operations require specialized personnel and equipment to be mobilized at the wellsite, and are therefore costly and hinder the frequency of their performance. Moreover, specialized software is often required to interpret tracer data during a gas-lift operation because it is rather difficult to detect the tracer data because of the continuous gas stream.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system is disclosed and includes a wellbore extending from a surface location, production tubing arranged within the wellbore and thereby defining an annulus between the production tubing and an inner wall of the wellbore, a plurality of gas-lift valves arranged on the production tubing and operable to receive a lift gas from the annulus and discharge the lift gas into an interior of the production tubing, a unique tracer provided at each gas-lift valve and releasable into the interior of the production tubing as the lift gas circulates through a corresponding one of the plurality of gas-lift valves, and a tracer detection system arranged at the surface location and operable to detect the unique tracer comingled with the lift gas and a production fluid circulating within the production tubing.

In another embodiment, a method of unloading a well during a gas-lift operation is disclosed and includes injecting a lift gas into an annulus defined between an inner wall of a wellbore extending from a surface location and production tubing arranged within the wellbore, wherein a plurality of gas-lift valves are axially spaced from each other along the production tubing, forcing a wellbore liquid within the annulus into the production tubing via the plurality of gas-lift valves and thereby progressively decreasing a column height of the wellbore liquid within the annulus, circulating the lift gas through a first gas-lift valve of the plurality of gas-lift valves as the column height decreases past an axial location of the first gas-lift valve, releasing a first unique tracer into the production tubing from the first gas-lift valve as the lift gas circulates through the first gas-lift valve, and detecting the first unique tracer comingled with the lift gas and a production fluid circulating within the production tubing with a tracer detection system arranged at the surface location.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
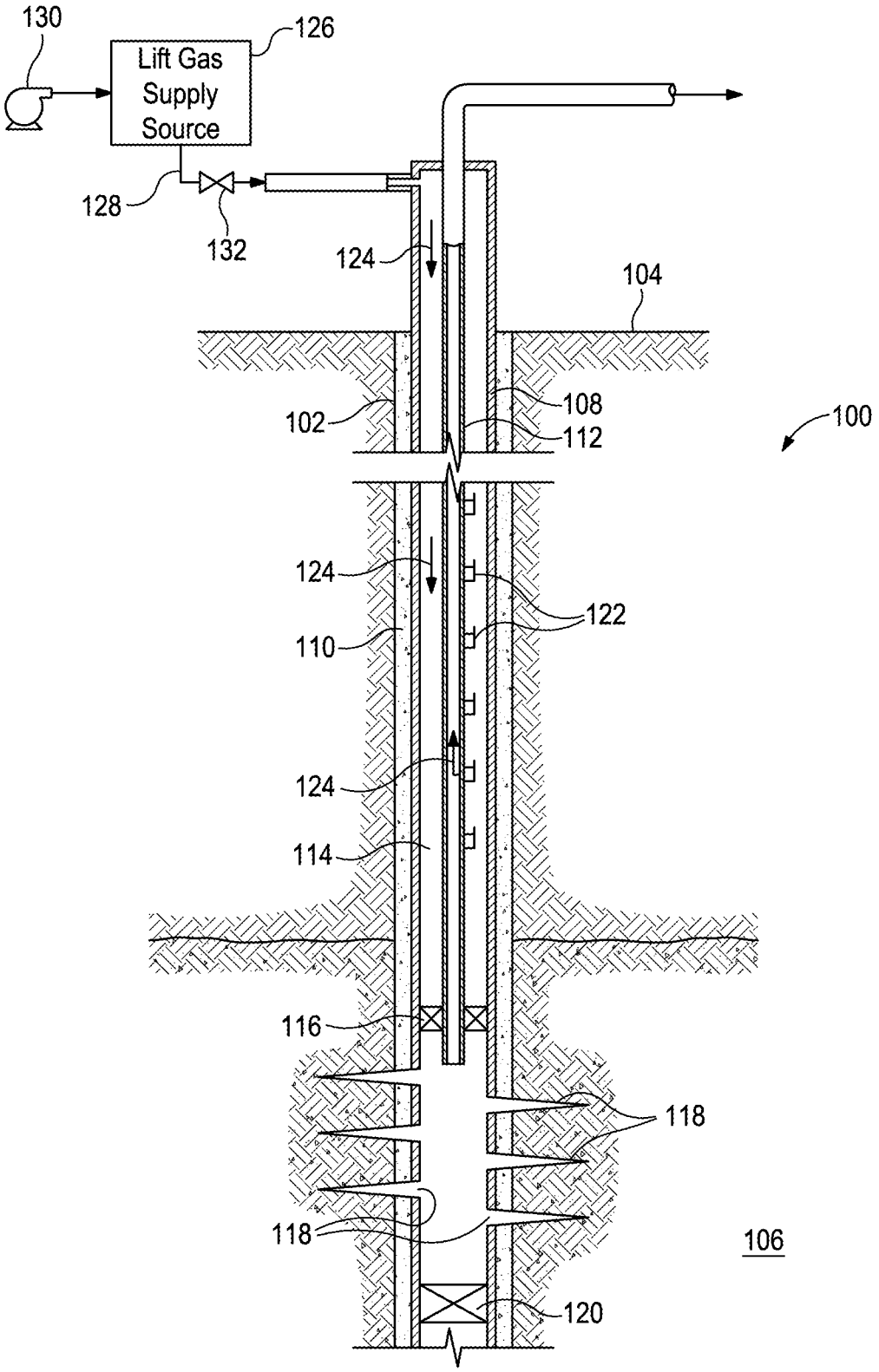
FIG. 1 is a schematic of an example well system, which can utilize the gas-lift devices of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

The present disclosure relates generally to hydrocarbon exploration operations in a subterranean well and, more particularly, to downhole gas-lift operations that include downhole valve-actuated tracers. In particular, different tracers may be installed at the level of each gas-lift valve and/or side pocket mandrel of a gas-lift mandrel, and each tracer exhibits a unique signature that, when detected at the well surface, will be an indication of the location from which it was released. The location could be an open gas-lift valve or a passing dummy valve. If a specific tracer has not been identified at the well surface, that may be an indication that the gas-lift valve is closed or the dummy valve is holding. Otherwise, if the tracer located at the operating gas-lift valve has not been detected, that may be an indication that the gas-lift injection has not reached the desired depth and maybe a shallower valve is open. Various combinations of detecting and not detecting a specific tracer, and how to interpret the situation, are presented in the present disclosure and shown in the accompanying drawings.

Samples of production fluid returns may be taken at the well surface location from one or more available sampling points, and the samples may be analyzed for the presence of the tracers. The well operator has the option of selecting the sampling frequency or being on call in the event that an anomaly or poor performance is noticed. In some embodiments, the requirement for manual samples could be eliminated if a digital mass spectrometer with online tracer monitor capability is installed at the well surface location. If a shut-in event can be associated with continuous sample collection or the online mass spectrometer, it may be possible to determine the quantitative contribution from each gas-lift valve or dummy valve.

The systems and method described herein may eliminate the requirement for special personnel and equipment to conduct conventional tracer surveys, which involve injecting a small amount of the tracer into the annulus along with the lift gas (e.g., treated gas, air, $CO_2$, $N_2$) and timing its arrival back to the surface to determine which valve is open and which is closed. Moreover, conventional tracer detection methods for gas-lift wells require specialized software to interpret the data, and due to the near impossibility of having continuous $N_2$ and $CO_2$ injection, the usual approach cannot be used on a real-time basis.

FIG. 1 is a schematic diagram of an example well system 100 that may incorporate the principles of the present disclosure. More specifically, the well system 100 may be configured for gas-lift, and therefore may be characterized as a gas-lift well system. As illustrated, the well system 100 includes a wellbore 102 drilled from a well surface location 104 and penetrating one or more subterranean, hydrocarbon-bearing formations 106. A string of casing 108 or another type of wellbore liner may be extended into the wellbore 102 and cemented into place using cement 110. While only one string of casing 108 is shown in FIG. 1, it is understood that a plurality of progressively smaller outer diameter strings of casing may be utilized and each cemented into place within wellbore 102.

The well system 100 also includes a string of production tubing 112 extended into the wellbore 102 from the well surface location 104 and arranged concentric with the casing 108. An annulus 114 is thereby defined between the production tubing 112 and the inner wall of the casing 110. The production tubing 112 extends downhole to at or near the subterranean formation 106. One or more wellbore isolation devices or "packers" 116 may be deployed within the wellbore 102 to seal the annulus 114 near a bottom of the production tubing 112.

In the depicted embodiment, the casing 108 has been perforated along the subterranean formation 106 thereby resulting in a plurality of perforations 118 that extend through the casing 108 and into the subterranean formation 106. Additionally, an optional bridge plug 120 may be set below the perforations 118.

The well system 100 further includes a plurality of gas-lift valves 122 installed along the production tubing 112 at predetermined locations. Each gas-lift valve 122 may be included with or otherwise form part of a corresponding gas-lift mandrel installed between opposing upper and lower portions of the production tubing 112. The gas-lift valves 122 may comprise traditional gas-lift valves for injecting a gas stream or "lift gas" 124 into the production tubing 112, but one or more of the gas-lift valves 122 may comprise a dummy valve, an unloading valve, or an orifice valve, as known in the art. The gas-lift valves 122 are configured to receive and inject the lift gas 124 from the annulus 114 into the production tubing 112, and the lift gas 124 helps reduce the density of production fluids flowing within the production tubing 112.

A lift gas supply source 126 located at the well surface 104 supplies the lift gas 124 through a lift gas supply line 128 in fluid communication with the annulus 114. The supply source 126 is pressurized using a compressor 130 and, in some embodiments, a valve 132 may be arranged within the supply line 128 to regulate the flow rate and pressure of the lift gas 124 as it enters the annulus 114.

Figure 2:
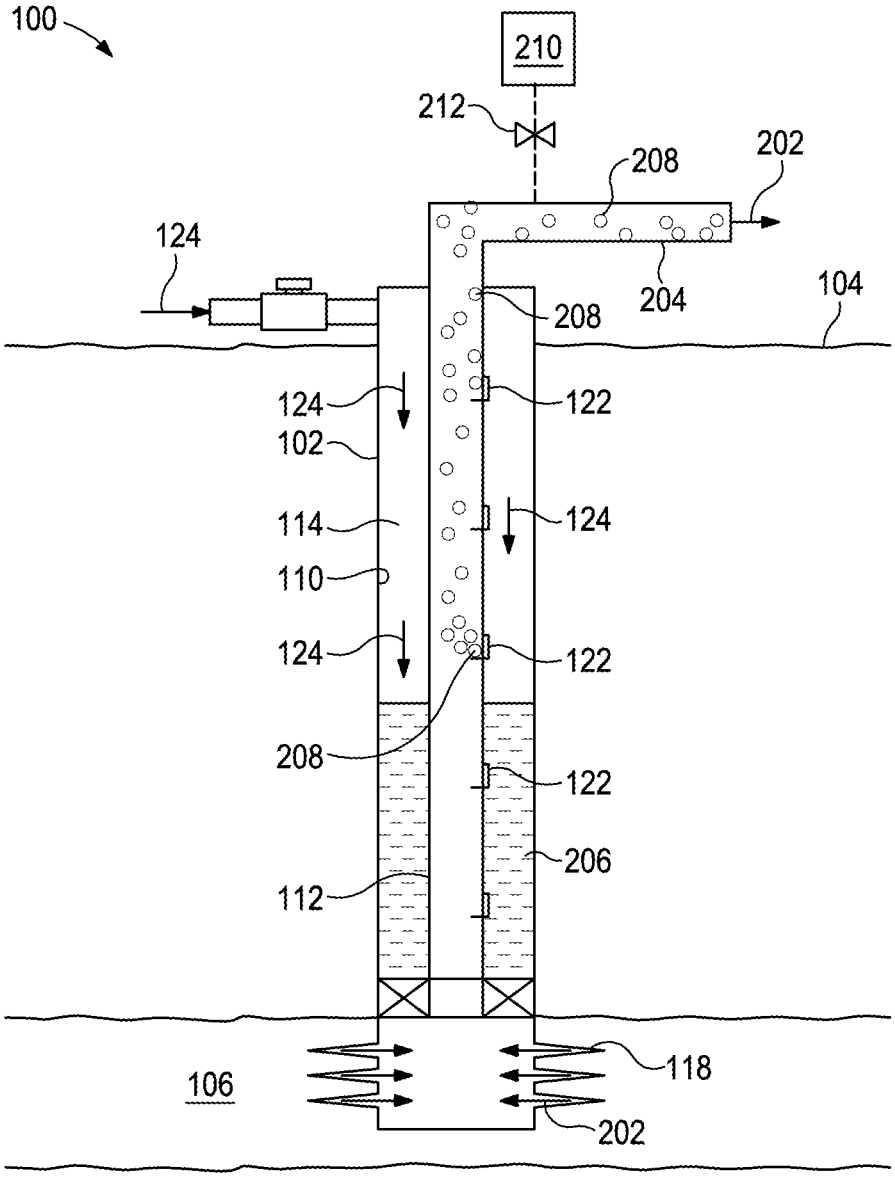
FIG. 2 is an enlarged, simplified schematic view of the well system of FIG. 1 showing example gas-lift operation, according to one or more aspects of the present disclosure.

FIG. 2 is an enlarged, simplified schematic view of the well system 100 showing example gas-lift operation, according to one or more aspects of the present disclosure. During gas-lift operations, reservoir or "production" fluids 202 (e.g., hydrocarbons) originating in the subterranean formation 106 enter the wellbore 102 through the perforations 118 and are received within the production tubing 112 to be conveyed to the well surface 104. Once received at the well surface 104, the production fluids 202 may exit the wellbore 102 via a produced fluid line 204.

In FIG. 2, the well system 100 is in the process of offloading or "unloading." which entails injecting the lift gas 124 into the annulus 114 and thereby forcing a wellbore liquid 206 within the annulus 114 into the production tubing 112 via the gas-lift valves 122. As depicted, the wellbore liquid 206 has accumulated in the lower (downhole) portion of the annulus 114, and the lift gas 124 is being continuously injected into the upper (uphole) portion of the annulus 114 to progressively force the wellbore liquid 206 into the production tubing 112. In the illustrated embodiment, five gas-lift valves 122 are placed axially along a production tubing 112, and each gas-lift valve 122 forms part of or is attached to a corresponding gas-lift mandrel arranged between opposing upper and lower portions of the production tubing 112. While five gas-lift valves 122 are shown in FIG. 2, more or less than five may be employed, without departing from the scope of the disclosure.

Once the accumulating lift gas 124 within the annulus 114 reaches a particular gas-lift valve 122, the lift gas 124 is able to migrate into the production tubing 112 via that gas-lift valve 122. Injecting the lift gas 124 into the production tubing 112 results in lighter hydrostatic pressures above the particular gas-lift valve 122 within the production tubing 112 by effectively reducing the density of the production fluids 202 contained therein. This reduction in hydrostatic pressure provides "lift" to the production fluids 202 for more easily flowing to the well surface 104.

As the column of the wellbore liquid 206 progresses downhole, the hydrostatic pressure within the annulus 114 decreases as the exposed gas-lift valves 122 progressively shut (close) at predetermined hydrostatic pressures reached within the annulus 114. This allows the column of wellbore liquid 206 to descend deeper into the annulus 114 to reach the remaining gas-lift valves 122. Once the lift gas 124 reaches a specific valve 122 and starts injecting from that valve, the gas-lift valve 122 above it is designed to close to concentrate the injection in one valve 122 only. Consequently, as the column of the wellbore liquid 206 progresses downward, the gas-lift valves 122 arranged above the column of the wellbore liquid 206 will eventually close once the pressure within the annulus 114 reaches a predetermined limit. This process will be repeated until the desired operation valve 122 is reached where the lift gas 124 will be injected continuously during well production.

According to embodiments of the present disclosure, each gas-lift valve 122 includes and is otherwise associated with a distinct or unique tracer material or "tracer" 208, in configurations consistent with those disclosed herein. As the lift gas 124 reaches a particular gas-lift valve 122, in some embodiments, the lift gas 124 contacts and activates the unique tracer 208 as it migrates into the production tubing 112 via the gas-lift valve 122. In other embodiments, or in addition thereto, the unique tracer 208 may be activated by the produced hydrocarbons within the production tubing 112 or otherwise may be entrained in the produced hydrocarbons. As a result, portions of the activated tracer 208 can then entrained in the lift gas 124 circulating through the gas-lift valve 122 and are thereby simultaneously discharged into the production tubing 112 along with the lift gas 124 to be comingled with the production fluid 202 (termed herein a "comingled fluid"). The tracer 208 discharged from each gas-lift valve 122 is unique to the particular gas-lift valve 122 and otherwise different from the tracer 208 included in the other gas-lift valves 122.

The well system 100 may further include a tracer detection system 210 arranged at the well surface 104 and in fluid communication with the produced fluid line 204. Samples of the production fluid 202, including produced hydrocarbons, the lift gas 124, and the tracer 208, may be taken and analyzed by the tracer detection system 210 for the presence of the tracers 208. By identifying a particular tracer 208 at the well surface location 102 using the tracer detection system 210, a well operator may be able to identify the entry point of the lift gas 124; i.e., the gas-lift valve 122 through which the lift gas 124 is currently flowing. This may prove advantageous in surveilling, troubleshooting, and optimizing the well system 100.

The tracers 208 can include, but are not limited to, organic or polymer-based tracers configured to react and degrade upon contact with the lift gas 124. As the material of the tracer 208 degrades, portion of the tracer 208 becomes entrained with the flowing lift gas 124 and is eventually discharged into the production tubing 112 to comingle with the production fluid 202. Examples of the tracer 208 include, but are not limited to, benzene tetracarboxylic acid, salts thereof, naphthalenediol, and mixtures thereof, and those disclosed in U.S. Pat. No. 5,246,860, the contents of which are incorporated herein in their entirety. As will be appreciated, the forgoing tracers are merely examples, and those skilled in the art will readily recognize that other types of tracers not mentioned herein may be equally suitable, without departing from the scope of the disclosure.

In some embodiments, the tracer detection system 210 may be in fluid communication with the produced fluid line 204 via one or more manual or automated valves 212 that allow a well operator to manually extract samples as needed. In such embodiments, the well operator has the option of selecting the sampling frequency or being on call in the event that an anomaly or poor performance is noticed. In other embodiments, however, the tracer detection system 210 may comprise a digital mass spectrometer with online tracer monitoring capabilities and in continuous fluid communication with the production fluid 202 flowing in the produced fluid line 204. In such embodiments, the requirement for manually extracting samples may be eliminated. Rather, the tracer detection system 210 may be configured for continuous sample collection and analysis. Moreover, using a digital mass spectrometer may make it possible to determine the quantitative contribution from each gas-lift valve 122. Nevertheless, it is contemplated herein that manual samples can be taken in the absence of a spectrometer, without departing from the scope of the disclosure.

In the illustrated embodiment of FIG. 2, the column of the wellbore liquid 206 has descended past the upper three gas-lift valves 122. As the liquid column progressively descends and the hydrostatic pressure within the annulus 114 correspondingly increases, the exposed gas-lift valves 122 will proceed to shut (close) once a predetermined hydrostatic pressure is reached within the annulus 114. Upon closing the upper two gas-lift valves 122, the lift gas 124 will be injected into the production tubing 112 via only the third gas-lift valve 122. The tracer 208 emitted from the third gas-lift valve 122 is unique to the third gas-lift valve 122, such that receipt and detection of the tracer 208 at the tracer detection system 210 provides a positive indication that the third gas-lift valve 122 is open and operating properly.

Once the gas-lift valves 122 close, their unique tracers 208 will not be discharged and therefore not detected at the tracer detection system 210. Accordingly, an operator, such as a gas-lift surveillance engineer, can draw two conclusions at this point: (1) either the gas-lift operation is operating or performing appropriately, or (2) if the third gas-lift valve 122 was intended to be an unloading valve and the operating valve (the valve that is expected to be open) was intended to be deeper, that the gas injection is shallow. Based on this knowledge, the operator may take any necessary corrective action, such as gas-lift redesign.

Accordingly, discharging the tracers 208 from the gas-lift valves 122 provide a method of determining what particular gas-lift valve 122 is operating since, once opened, the unique tracer 208 is released within the lift gas 124 and travels to the well surface 104 for detection. This is possible because unique tracers 208 having unique signatures are associated with each gas-lift valve 122, thus allowing an operator to understand the operating effectiveness of the gas-lift operation.

In some instances, a gas-lift dummy valve may be installed in a corresponding gas-lift mandrel, such that the opening of a true gas-lift valve below the dummy provides an indication of operability of the gas-lift operation, depending upon the design thereof. Moreover, if an expected unique tracer 208 is not detected at the tracer detection system 210, this may be an indication of a lack of annulus communication (e.g., a lower gas-lift valve 122 is closed and a gas-lift dummy valve above also remains holding). Further, if an expected tracer 208 has not been detected, that may provide an indication that the injection of the lift gas 124 has not yet reached the particular depth where the expected tracer 208 would be released.

At the tracer detection system 210, samples of the production fluid 202 are taken and analyzed for the presence of any unique tracer(s) 208. Sampling frequency may be based on the design of the gas-lift operation and in the event of an anomaly or if poor performance is detected based on the analysis, corrective action(s) may be taken. As indicated above, manual sampling may be eliminated by including an analyzer in-line with the produced fluid line 204, such as a digital mass spectrometer. Moreover, a shut-in event can be associated with continuous sampling by an in-line analyzer to determine quantitative contribution from each unique tracer 208.

Figure 3:
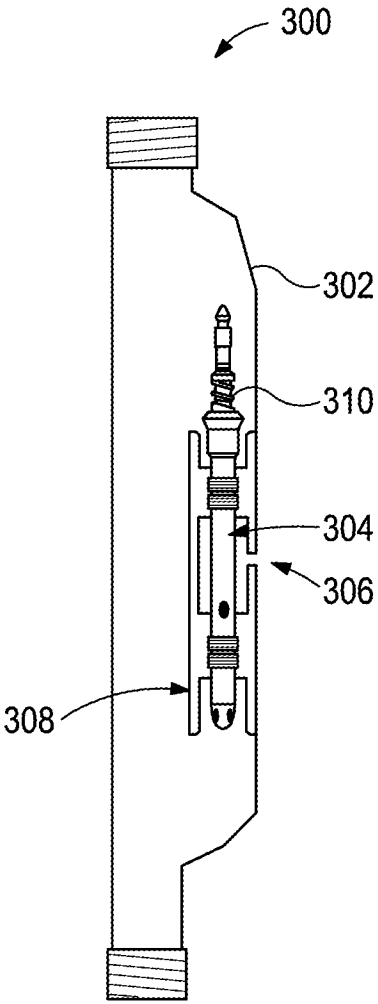
FIG. 3 is an example of a conventional gas-lift mandrel comprising a gas-lift valve.

FIG. 3 is a conventional gas-lift mandrel 300 having a side pocket 302 for housing a conventional gas-lift valve 304. The gas-lift mandrel 300 is essentially a tubular having opposing upper and lower ends configured to be installed between upper and lower portions of a production tubing (e.g., the production tubing 112 of FIGS. 1 and 2). Once installed in the production tubing, the gas-lift mandrel 300 can be conveyed into a wellbore to a predetermined depth.

The gas-lift valve 304 may be the same as or similar to any of the gas-lift valves 122 of FIGS. 1 and 2, thus the gas-lift mandrel 300 and the gas-lift valve 304 housed within the gas-lift mandrel 300 may be included in the well system 100 of FIGS. 1 and 2. The gas-lift valve 304 is held in place in a side pocket housing 308 arranged within or otherwise formed by the side pocket 302. Fluids (e.g., unloading liquids, lift gas, etc.) are able to access the gas-lift valve 304 via a gas-lift entry 306. Such fluids are able to migrate into the production tubing by circulating through the gas-lift valve 304. The gas-lift valve 304 may include a biasing element 310 that helps hold the gas-lift valve 304 in place within the gas-lift mandrel 300.

Figure 4:
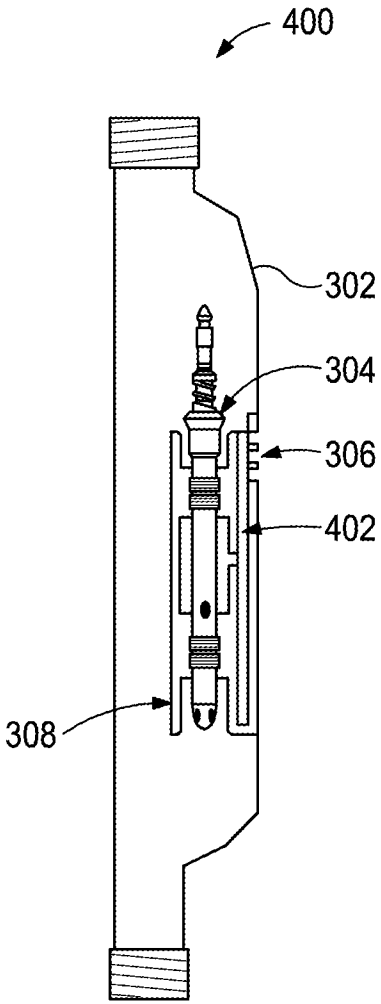

FIG. 4 is an example gas-lift mandrel 400 in accordance with the principles of the present disclosure. The gas-lift mandrel 400 may be similar in some respects to the gas-lift mandrel 300 of FIG. 3, and therefore may be best understood with reference thereto, where like numerals will represent like components not described again in detail. Similar to the gas-lift mandrel 300 of FIG. 3, for example, the gas-lift mandrel 400 includes the side pocket 302 and the gas-lift valve 304, and the gas-lift valve 304 is held in place with the side pocket housing 308.

Unlike the gas-lift mandrel 300 of FIG. 3, however, the gas-lift mandrel 400 includes a tracer holder 402 configured to contain a unique tracer (e.g., the tracer 208 of FIG. 2). The tracer holder 402 may comprise, for example, a container that contains the unique tracer, but also serves to place the gas-lift valve 304 in fluid communication with the gas-lift entry 306. Consequently, lift gas is able to access the gas-lift valve 304 by first circulating through the tracer holder 402 via the gas-lift entry 306, which is in communication with the annulus (e.g., the annulus 114 of FIGS. 1 and 2). The lift gas circulates through the tracer holder 402 while simultaneously contacting and activating the unique tracer, which allows a portion of the tracer to be entrained within the flowing lift gas. As a result, a combination of the lift gas and the tracer are conveyed to the gas-lift valve 304 and discharged from the gas-lift valve 304 into the production tubing. The combination of the lift gas and the unique tracer may then comingle with production fluids flowing within the production tubing and be conveyed to the well surface location.

Figure 5:
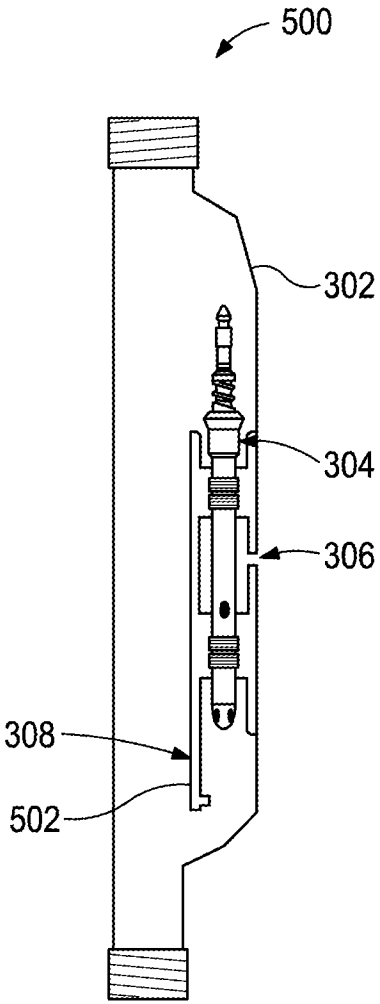
FIGS. 4 and 5 are examples of modified gas-lift mandrels, according to one or more embodiments of the present disclosure.

FIG. 5 shows another modified gas-lift mandrel 500, according to one or more additional embodiments of the present disclosure. As with the modified gas-lift mandrel 400 of FIG. 4, the modified gas-lift mandrel 500 may be similar in some respects to the gas-lift mandrel 300 of FIG. 3 and therefore may be best understood with reference thereto, where like numerals will again represent like components. As illustrated, the modified configuration of the gas-lift mandrel 500 includes modification of a portion of the side pocket 302 and, more specifically, the side pocket housing 308, which is configured to hold the gas-lift valve 304. More particularly, the side pocket housing 308 may include an axial extension 502 that extends distally past the downhole end of the gas-lift valve 304. The axial extension 502 may prove advantageous in allowing the side pocket 302 to house additional tracer material. The additional tracer material may be housed within a pocket or patched (secured) to the axial extension 502. Moreover, the axial extension 502 may be advantageous in creating a stagnant flow zone in order for the unique tracer to remain therein (e.g., not to flow).

The axial length of the axial extension 502 may be determined by computational fluid dynamics (CFD) (see Examples herein). The modified gas-lift mandrel 500 permits gas to access the gas-lift valve 304 through the gas-lift entry 306, as would be the case for a conventional gas-lift mandrel.

Figure 6:
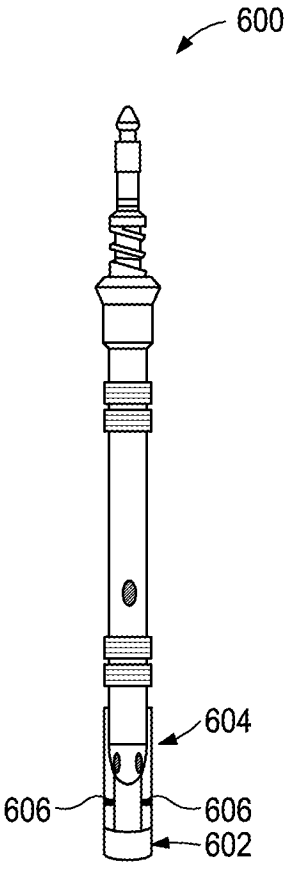

FIG. 6 illustrates another modified gas-lift valve 600, according to one or more additional embodiments. The gas-lift valve 600 may be similar in some respects to the gas-lift valve 304 of FIGS. 3-5, and may thus also be used in the well system 100 of FIGS. 1 and 2. In at least one embodiment, the gas-lift valve 600 may be used with the modified gas-lift mandrel of FIG. 5, and therefore may replace the gas-lift valve 304 of FIG. 5. As shown, the gas-lift valve 600 includes a distal extension 602 operatively coupled to a lower or "discharge" end 604 of the gas-lift valve 600. The distal extension 602 may comprise a container or vessel configured to hold and/or store tracer material (e.g., the tracer 208 of FIG. 2). In some embodiments, the tracer material may be coated on the inner (or outer) walls of the distal extension 602.

As the lift gas is discharged from the gas-lift valve 600 at the discharge end 604, the tracer stored within the distal extension 602 becomes entrained in the flow of the lift gas and a combination of the lift gas and the unique tracer is discharged from the distal extension 602 via one or more holes 606 defined in the body of the distal extension 602. The distal extension 602 may be operatively coupled to the discharge end 604 of the gas-lift valve 600 by any mechanical or chemical (e.g., adhesion) means.

To allow for a stagnant flow zone at the gas-lift valve 600, in the event the gas-lift valve 600 is closed and the tracer cannot flow out of the extension 602, the improved gas-lift valve 600 of FIG. 6 may advantageously be coupled with the modified gas-lift mandrel of FIG. 5. This may prove advantageous in allowing the tracer to be exchanged or replenished with each replacement of the gas-lift valve 600.

Figure 8:
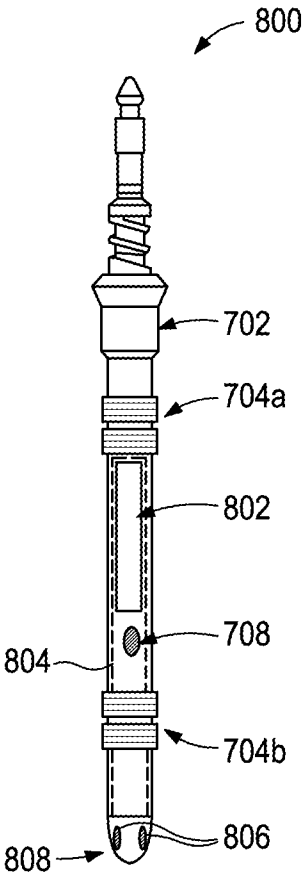
FIGS. 6-8 are examples of modified gas-lift valves, according to one or more embodiments of the present disclosure.
Figure 7:
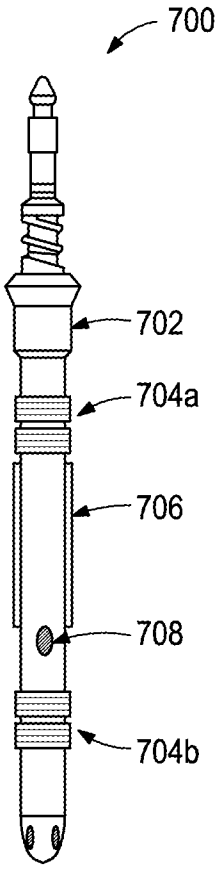

FIGS. 7 and 8 show additional gas-lift valve modifications for use in discharging a unique tracer into interconnected production tubing, according to one or more embodiments of the present disclosure. The gas-lift valves 700 and 800 shown in FIGS. 7 and 8, respectively, may be similar in some respects to the gas-lift valve 304 of FIGS. 3-5 and may thus also be used in the well system 100 of FIGS. 1 and 2.

Referring first to FIG. 7, the gas-lift valve 700 includes and elongate body 702 and upper and lower seal assemblies 704*a* and 704*b* axially spaced from each other and coupled to the exterior of the elongate body 702. A tracer material 706 may be axially arranged about the exterior circumference of the body 702 between seals 704*a,b*. The tracer material 706 may be positioned on the body 702 in such a manner that an inlet orifice or "gas lift entry" 708 defined in the body 702 is not occluded. That is, the tracer material 706 may be positioned on outer surfaces of the gas-lift valve 700 in any manner or configuration as long as the gas lift entry 708 is not occluded (covered). In some embodiments, the tracer material 706 may comprise a rolling patch secured to the exterior of the gas-lift valve 700, and its thickness may be designed to allow for smooth placement and retrieval of the gas-lift valve 700.

As the incoming lift gas contacts and reacts with the tracer material 706, portions of the tracer material 706 may release from the body 702 and become entrained in the lift gas. A combination of the lift gas and the tracer material 706 may then flow into the gas lift entry 708 to be discharged into the interior of the production tubing for recovery at the well surface location. The tracer material 706 may be attached to, coupled to, and otherwise coated to the exterior circumference of the body 702 by a variety of means, and depending on the particular type of tracer selected, for example.

The gas-lift valve 700 may be particularly amenable for coatings on gas-lift dummy valves (those that do not allow annulus and tubing communication unless they have failed). When the particular tracer type is detected from such a valve, an operator will be informed that the gas-lift operation may have a failure or may otherwise take appropriate corrective action.

Referring now to FIG. 8, the gas-lift valve 800 is similar in some respects to the gas-lift valve 700 of FIG. 7, and therefore may be best understood with reference thereto where like numerals will represent like components not described again in detail. For example, the gas-lift valve 800 includes the elongate body 702 and the upper and lower seal assemblies 704*a,b* secured to the exterior of the body 702.

Unlike the gas-lift valve 700, however, the gas-lift valve 800 includes a unique tracer material 802 arranged within a flowpath 804 defined within the body 702. The flowpath 804 fluidly communicates the gas lift entry 708 with one or more discharge ports 806 (two shown) at the bottom or distal end 808 of the gas-lift valve 800. The tracer material 802 may be in the form of a rigid or semi-rigid stick or a rod sized to be received within the flowpath 804. As the lift gas enters the gas-lift valve 800 via the gas lift entry 708, it impinges upon the tracer material 802 and a portion of the tracer material 802 may be entrained with the lift gas to be discharged into the production tubing via the discharge ports 806. Having the tracer material 802 in stick or rod form may prove advantageous in allowing easy replacement in the event that the modified gas-lift valve 800 requires refurbishing or replacement. The gas-lift valve 800 may further prove advantageous when applied to orifice valves where the $N_2$ dome within a conventional gas lift valve can be omitted since the orifice valve does not require a mechanism to be opened or closed.

Figure 9:
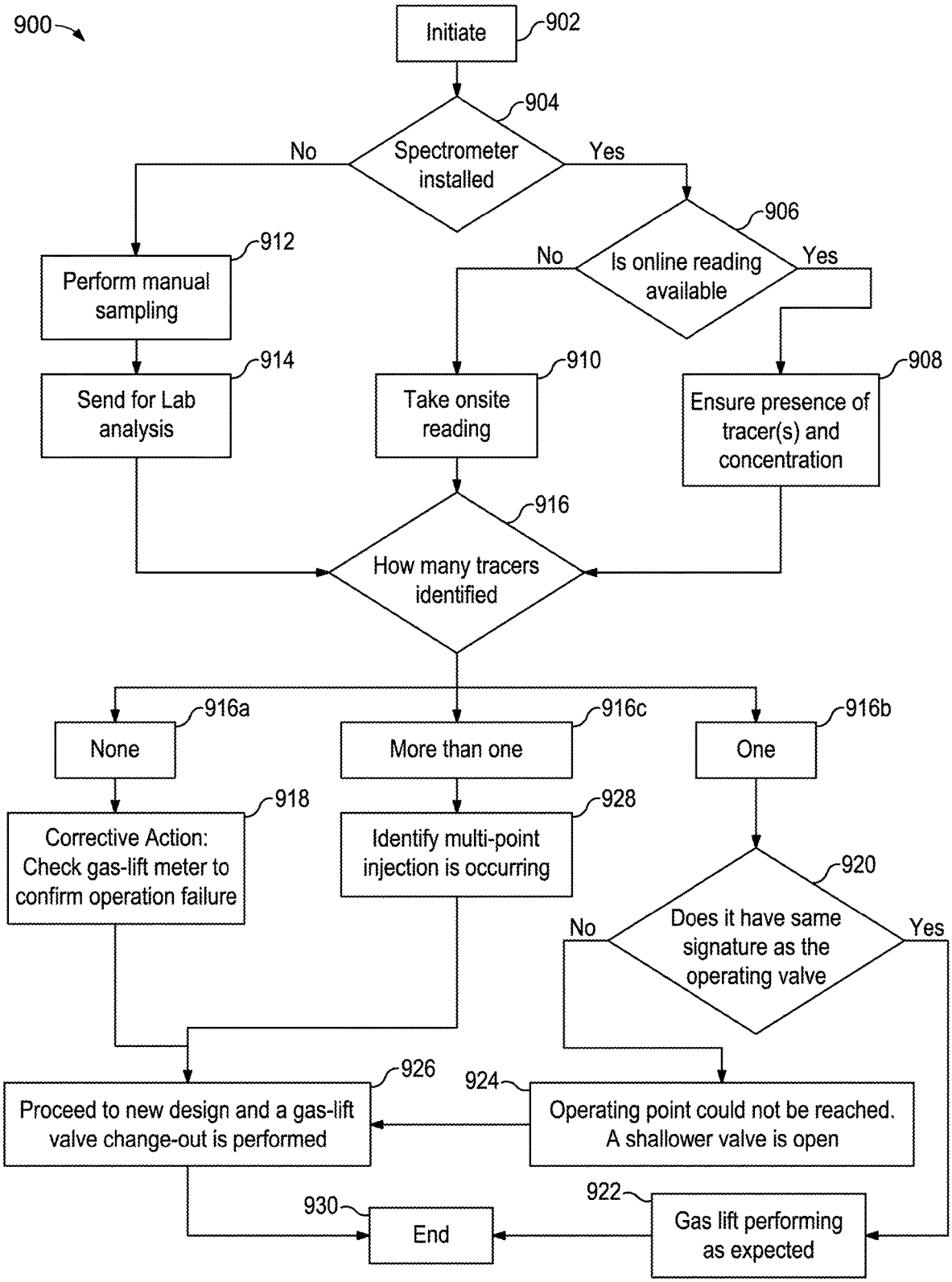
FIG. 9 is an exemplary surveillance workflow employing the gas-lift tracer delivery devices of the present disclosure.

FIG. 9 is an example surveillance workflow method 900, according to one or more embodiments disclosed herein. The method 900 is employed to provide gas-lift surveillance with downhole tracers dischargeable from a plurality of gas-lift valves installed along production tubing extended within a wellbore. The method 900 is initiated at 902 and it is determined whether an in-line spectrometer (analyzer) is installed, as at 904.

If an in-line spectrometer is installed, then it is determined whether an online tracer reading is available, as at 906. If an online tracer reading is available, the online tracer reading is evaluated for the presence of tracer(s) and the concentration of the tracer(s), as at 908. If an online tracer reading is not available, an onsite sample reading is taken with the spectrometer, as at 910.

If an in-line spectrometer is not installed, as determined at 904, manual sampling is performed from the production fluid, as at 912, and any samples extracted may be sent for lab analysis, as at 914.

Whether results are obtained from the online tracer reading evaluation, as at 908, the onsite reading from the spectrometer, as at 910, or the lab analysis, as at 914, the number of tracers are then identified, as at 916. If no tracer is identified, as at 916*a*, that is an indication that the gas-lift operation is not functional or not properly functioning, and corrective action may then be taken, as at 918. Example corrective actions include, but are not limited to, checking the gas-lift meter to confirm operation failure (i.e., no gas-lift injection occurring). Thereafter, a new gas-lift design is created including one or more gas-lift valve change-outs, as at 926, and the method terminates at 930.

If a single tracer is identified, as at 916*b*, it is determined whether the identified tracer has the same tracer signature as the intended operating gas-lift valve, as at 920. If the single tracer identified has the same signature as the intended operating valve, as at 920, that may be an indication that the gas-lift operation is performing properly, as at 922. In such a scenario, no further action is needed and the method is terminated at 930. If the single tracer identified does not have the same signature as the intended operating valve as at 920, that may be an indication that the intended operating point could not be reached and a shallower gas-lift valve is instead opened, as at 924. This may necessitate the creation of a new design including one or more gas-lift valve change-outs, as at 926, and the method is terminated at 930.

If more than one tracer is identified, as at 916*c*, that may be an indication that multiple gas-lift valves are open, sometimes referred to as multi-point gas injection, as at 928. This may necessitate the creation of a new design including one or more gas-lift valve change-outs, as at 926, and the method is terminated at 930.

To facilitate a better understanding of the embodiments of the present invention, the following examples of preferred or representative embodiments are given. In no way should the following examples be read to limit, or to define, the scope of the invention.

EXAMPLES

Figure 10:
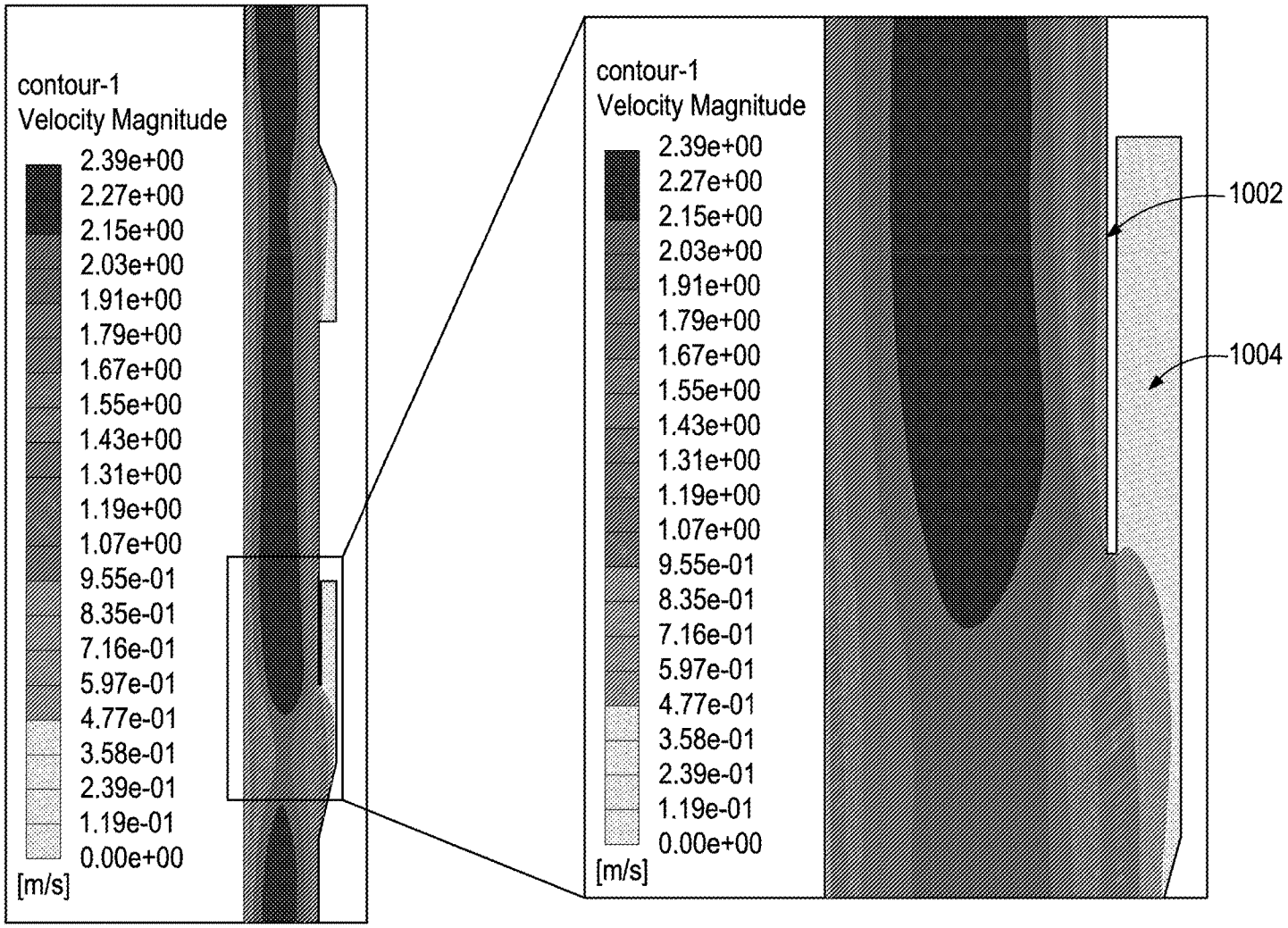
FIG. 10 is a computational fluid dynamics (CFD) simulation of gas-lift mandrel modified to have a side pocket housing extension according to an embodiment of the present disclosure.

Example 1: FIG. 10 depicts a computational fluid dynamics (CDF) simulation that identifies a stagnation zone within an example gas-lift mandrel, according to one or more embodiments of the present disclosure. More specifically, the gas-lift mandrel depicted in FIG. 10 may be the same as or similar to the gas-lift mandrel 500 of FIG. 5. In the illustrated example, the gas-lift mandrel includes a gas-lift valve pocket extension 1002 similar to the axial extension 502 of FIG. 5. As illustrated, a stagnation zone 1004 with effectively zero velocity is formed. The stagnation zone 1004 may be designed and otherwise configured to ensure no tracer flow when the valve is closed.

Figure 11B:
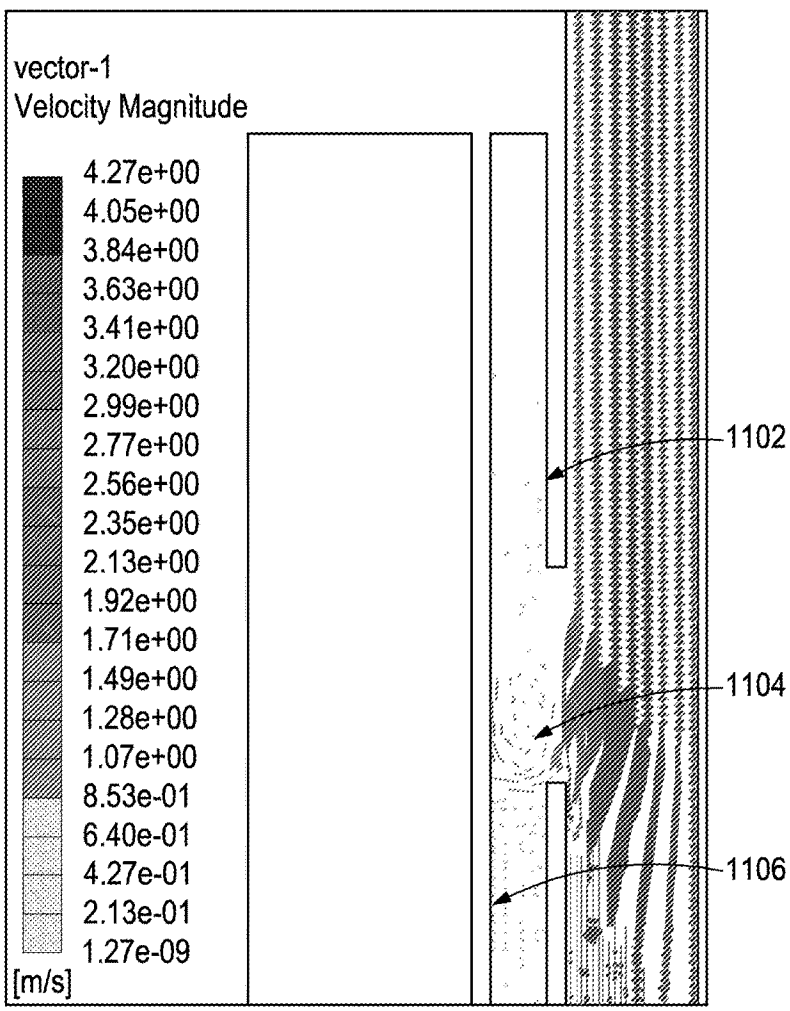
FIG. 11B is a velocity vector plot of the location shown in FIG. 11A.
Figure 11A:
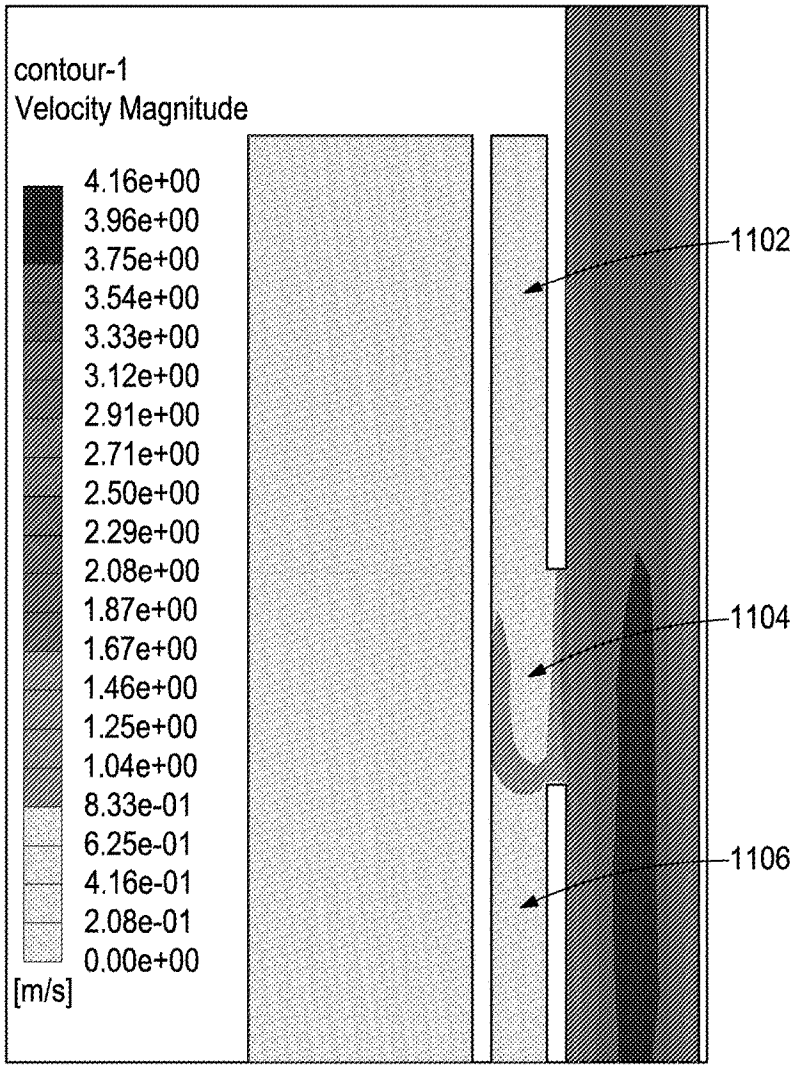
FIG. 11A depicts a computational fluid dynamics (CFD) simulation showing the velocity contours around an example gas-lift mandrel, according to one or more embodiments of the disclosure.

Example 2: FIG. 11*a* depicts a computational fluid dynamics (CFD) simulation showing the velocity contours around an example gas-lift mandrel, and FIG. 11B is a velocity vector plot of the same location shown in FIG. 11A, according to one or more embodiments of the disclosure. In particular, the gas-lift mandrel shown in FIGS. 11A-11B may be the same as or similar to the gas-lift mandrel 400 of FIG. 4, which includes the tracer holder 402. In the illustrated embodiment, the gas-lift mandrel includes a tracer holder 1102, similar to the tracer holder 402, and in fluid communication with gas-lift entry 1104.

The CDF simulation of FIG. 11A shows a circulation zone of very low velocity around the gas entry point 1104, and FIG. 11B shows velocity contours around the gas-lift entry point 1104, which confirms that the tracer placed below it will be in a stagnant zone 1106 and, therefore, will be unable to flow downward to other valves with the gas-lift system. Accordingly, the velocity contours in FIG. 11B demonstrate that the circulation zone is only around the gas entry point 1104, and no movement occurs below in the stagnant zone 1106, thus assuring that the tracer will not flow downward with gas-lift to the gas-lift valves that are located downhole.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and are not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

production tubing arranged within a wellbore and thereby defining an annulus between the production tubing and an inner wall of the wellbore; and a gas-lift valve operable to receive a lift gas from the annulus and discharge the lift gas into an interior of the production tubing, wherein the gas lift valve comprises:

a tracer releasable into the interior of the production tubing as the lift gas passes through the gas-lift valve;

an elongate body that defines a gas lift entry and one or more discharge ports defined at a discharged end of the elongate body; and upper and lower seal assemblies axially spaced from each other and coupled to an exterior of the elongate body, wherein the unique tracer is axially arranged about the exterior between upper and lower seals but not occluding the gas lift entry.

2. The well system of claim 1, wherein the unique tracer comprises an organic tracer or a polymer-based tracer.

3. The well system of claim 1, wherein the unique tracer is selected from the group consisting of benzene tetracarboxylic acid, a benzene tetracarboxylic acid salt, naphthalenediol, and any mixture thereof.

4. The well system of claim 1, further comprising a digital mass spectrometer in-line with a produced fluid line extending from the wellbore, the digital mass spectrometer being operable to monitor the production fluid within the produced fluid line for the presence of the unique tracer.

5. The well system of claim 1, wherein the unique tracer is reactive with the lift gas such that a portion of the unique tracer is entrained in the lift gas.

6. A well system, comprising:

production tubing arranged within a wellbore and thereby defining an annulus between the production tubing and an inner wall of the wellbore;

a plurality of gas-lift valves arranged on the production tubing and operable to receive a lift gas from the annulus and discharge the lift gas into an interior of the production tubing;

a unique tracer provided at each gas-lift valve and releasable into the interior of the production tubing as the lift gas circulates through a corresponding one of the plurality of gas-lift valves; and a tracer detection system arranged at the surface location and operable to detect the unique tracers comingled with the lift gas and a production fluid circulating within the production tubing, wherein at least one of the plurality of gas-lift valves includes:

an elongate body that defines a gas lift entry and one or more discharge ports defined at a discharge end of the elongate body; and upper and lower seal assemblies axially spaced from each other and coupled to an exterior of the elongate body, the unique tracer being arranged about the exterior between the upper and lower seals but not occluding the gas lift entry.

7. The well system of claim 6, wherein the unique tracer comprises an organic tracer or a polymer-based tracer.

8. The well system of claim 6, wherein the unique tracer is selected from the group consisting of benzene tetracarboxylic acid, a benzene tetracarboxylic acid salt, naphthalenediol, and any mixture thereof.

9. The well system of claim 6, wherein the tracer detection system is in fluid communication with a produced fluid line extending from the wellbore, and wherein one or more actuatable valves interpose the tracer detection system and the produced fluid line.

10. The well system of claim 6, wherein the tracer detection system comprises a digital mass spectrometer in-line with a produced fluid line extending from the wellbore, the digital mass spectrometer being operable to continuously monitor the production fluid within the produced fluid line for the presence of the unique tracer.

11. The well system of claim 6, wherein each gas-lift valve is installed in a corresponding gas-lift mandrel arranged between opposing upper and lower portions of the production tubing, and wherein at least one of the gas-lift valves includes a tracer holder that contains the unique tracer and interposes the gas-lift valve and a gas-lift entry, wherein the lift gas is received through the gas-lift entry and circulates through the tracer holder before reaching the at least one of the gas-lift valves.

12. The well system of claim 11, wherein circulating the lift gas through the tracer holder contacts and activates the unique tracer and thereby entrains a portion of the unique tracer within the lift gas to be discharged from the at least one of the gas-lift valves into the interior of the production tubing.

13. The well system of claim 6, wherein each gas-lift valve is installed in a corresponding gas-lift mandrel arranged between opposing upper and lower portions of the production tubing, each gas-lift valve being arranged within a side pocket provided by the corresponding gas-lift mandrel and secured within a side pocket housing, and wherein the side pocket housing of at least one of the gas-lift valves includes an axial extension that extends distally past a downhole end of the at least one of the gas-lift valves.

14. The well system of claim 6, wherein the at least one of the plurality of gas-lift valves comprises a first gas-lift valve, and the well system further comprises a second gas-lift valve that includes a distal extension operatively coupled to a discharge end of the second gas-lift valve, the distal extension housing the unique tracer and defining one or more holes through which the unique tracer and the lift gas are discharged from the second gas-lift valve.

15. The well system of claim 6, wherein the at least one of the plurality of gas-lift valves comprises a first gas-lift valve, and the well system further comprises a second gas-lift valve that includes:

an elongate body having opposing upper and lower ends and a flowpath defined within the elongate body between the upper and lower ends;

a gas lift entry defined between the upper and lower ends and providing fluid communication into the flowpath; and one or more discharge ports defined at the lower end and in fluid communication with the flowpath, wherein the unique tracer is positioned within the flowpath.

16. The well system of claim 6, wherein the corrective action comprises changing out one or more of the plurality of gas-lift valves.

17. The well system of claim 6, wherein the tracer detection system is further operable to:

determine that more than one of the plurality of gas-lift valves is open based on the detection; and determine that a corrective action is required based on the determining that more than one of the plurality of gas-lift valves is open.

18. A method, comprising:

injecting a lift gas into an annulus defined between an inner wall of a wellbore extending from a surface location and production tubing arranged within the wellbore;

forcing a wellbore liquid within the annulus into the production tubing via a plurality of gas-lift valves to thereby progressively decrease a column height of the wellbore liquid past an axial location of a first gas-lift valve of the plurality of gas lift valves;

circulating the lift gas through the first gas-lift valve based on the column height decreasing past the axial location of the first gas-lift valve;

detecting a first unique tracer comingled with the lift gas and a production fluid circulating within the production tubing with a tracer detection system arranged at the surface location based on the column height decreasing past the axial location of the first gas-lift valve;

forcing the wellbore liquid within the annulus into the production tubing via the plurality of gas-lift valves to thereby progressively decrease the column height of the wellbore liquid past an axial location of a second gas-lift valve of the plurality of gas lift valves;

detecting the first unique tracer, but not a second unique tracer associated with the second gas-lift valve, comingled with the lift gas and the production fluid circulating within the production tubing with the tracer detection system based on the column height decreasing past the axial location of the second gas-lift valve; and determining that second gas-lift valve failed to open based on the detected first unique tracer and failed detection of the second unique tracer.

19. The method of claim 18, wherein the tracer detection system comprises a digital mass spectrometer in-line with a produced fluid line extending from the wellbore, the method further comprising continuously monitoring production fluid within the produced fluid line for the first unique tracer with the digital mass spectrometer.

20. The method of claim 18, further comprising determining that a corrective action is required based on the determination that the second gas-lift valve failed to open.

* * * * *